US007874373B2

(12) United States Patent
Morrow et al.

(10) Patent No.: US 7,874,373 B2
(45) Date of Patent: Jan. 25, 2011

(54) PUMP SYSTEM FOR A FIREFIGHTING VEHICLE

(75) Inventors: Jon Morrow, Neenah, WI (US); Dave Steinberger, Larsen, WI (US); Corey Voigt, Menasha, WI (US); Tim Meilahn, Oshkosh, WI (US)

(73) Assignee: Oshkosh Corporation, Oshkosh, WI (US)

( * ) Notice: Subject to any disclaimer, the term of this patent is extended or adjusted under 35 U.S.C. 154(b) by 366 days.

(21) Appl. No.: 11/551,096

(22) Filed: Oct. 19, 2006

(65) Prior Publication Data

US 2008/0099213 A1 May 1, 2008

(51) Int. Cl.
*A62C 27/00* (2006.01)

(52) U.S. Cl. ..... 169/24

(58) Field of Classification Search ..... 169/24, 169/52, 9, 14, 16; 239/172, 436, 443, 444; 137/565.3, 565.35; 417/244, 428, 426
See application file for complete search history.

(56) References Cited

U.S. PATENT DOCUMENTS

| | | | | |
|---|---|---|---|---|
| 1,001,863 | A | 8/1911 | Kirkwood | |
| 1,376,467 | A | 5/1921 | Simmon | |
| 1,463,569 | A | 7/1923 | Bathrick | |
| 1,835,132 | A | 12/1931 | Anania | |
| 2,632,577 | A | 3/1953 | Sacco | |
| 2,642,944 | A * | 6/1953 | Allen | 169/11 |
| 2,916,997 | A | 12/1959 | Terrie | |
| 2,997,242 | A | 8/1961 | Grosholz | |
| 3,010,533 | A | 11/1961 | Ross | |
| 3,083,790 | A | 4/1963 | McAfee et al. | |
| 3,188,966 | A | 6/1965 | Tetlow | |
| 3,500,961 | A | 3/1970 | Eberhardt et al. | |
| 3,590,948 | A | 7/1971 | Milner, Jr. | |
| 3,726,308 | A | 4/1973 | Eberhardt | |
| 3,786,835 | A * | 1/1974 | Finger | 137/565.3 |
| 3,840,074 | A * | 10/1974 | Clark | 169/24 |
| 4,037,664 | A | 7/1977 | Gibson | |
| 4,059,170 | A | 11/1977 | Young | |
| 4,084,522 | A | 4/1978 | Yonger | |

(Continued)

FOREIGN PATENT DOCUMENTS

CA 2478228 A1 2/2006

(Continued)

OTHER PUBLICATIONS

Graphic image of what is understood by Applicants to be a 1923 Seagrave from the City of Los Angeles Fire Department in which the driver of the vehicle, in a non-tilt open truck cab, sat in a seat positioned over a fire pump (1 photograph, one sheet).

(Continued)

*Primary Examiner*—Davis Hwu
(74) *Attorney, Agent, or Firm*—Foley & Lardner LLP

(57) ABSTRACT

A firefighting vehicle having a dual pressure pump system includes a fluid supply, a first pump stage coupled to the fluid supply and configured to pump fluid at a first pressure, a second pump stage coupled to the first pump stage and configured to pump fluid at a second pressure, the second pressure being substantially different from the first pressure, a fluid manipulator; and a valving arrangement coupling the first pump stage and the second pump stage to the fluid manipulator, the valving arrangement being selectively adjustable between a first position forming a first fluid path and a second position forming a second fluid path, wherein the first fluid path provides the fluid to the fluid manipulator at a first output pressure and the second fluid path provides fluid to the fluid manipulator at a second output pressure.

22 Claims, 3 Drawing Sheets

U.S. PATENT DOCUMENTS

| | | | | |
|---|---|---|---|---|
| 4,103,757 | A | | 8/1978 | McVaugh |
| 4,157,733 | A | | 6/1979 | Ewers et al. |
| 4,160,492 | A | | 7/1979 | Johnston |
| 4,185,924 | A | | 1/1980 | Graham |
| 4,337,830 | A | | 7/1982 | Eberhardt |
| 4,373,600 | A | | 2/1983 | Buschbom et al. |
| 4,456,093 | A | | 6/1984 | Finley et al. |
| 4,563,124 | A | | 1/1986 | Eskew |
| 4,586,743 | A | | 5/1986 | Edwards et al. |
| 4,587,862 | A | | 5/1986 | Hoffman |
| 4,645,009 | A | * | 2/1987 | Hawelka et al. ..... 169/15 |
| 4,811,804 | A | | 3/1989 | Ewers et al. |
| 4,945,780 | A | | 8/1990 | Bosma |
| 5,004,156 | A | | 4/1991 | Montanier |
| 5,021,917 | A | | 6/1991 | Pike et al. |
| 5,113,946 | A | | 5/1992 | Cooper |
| 5,158,614 | A | | 10/1992 | Takeuchi |
| 5,211,245 | A | | 5/1993 | Relyea et al. |
| 5,301,756 | A | | 4/1994 | Relyea et al. |
| 5,346,334 | A | | 9/1994 | Einaru et al. |
| 5,368,317 | A | | 11/1994 | McCombs et al. |
| 5,467,827 | A | | 11/1995 | McLoughlin |
| 5,538,185 | A | | 7/1996 | Rabitsch et al. |
| 5,553,673 | A | | 9/1996 | Hackman |
| 5,617,696 | A | | 4/1997 | Young |
| 5,746,396 | A | | 5/1998 | Thorton-Trump |
| 5,785,372 | A | | 7/1998 | Glatzmeier et al. |
| 5,788,158 | A | | 8/1998 | Relyea |
| 5,826,663 | A | | 10/1998 | Sundholm |
| 5,839,664 | A | | 11/1998 | Relyea |
| RE36,196 | E | | 4/1999 | Eberhardt |
| 5,899,276 | A | | 5/1999 | Relyea et al. |
| 5,909,780 | A | | 6/1999 | De Andrade |
| 6,009,953 | A | | 1/2000 | Laskaris et al. |
| 6,155,351 | A | * | 12/2000 | Breedlove et al. ..... 169/14 |
| 6,220,532 | B1 | | 4/2001 | Manon et al. |
| 6,289,995 | B1 | | 9/2001 | Fuller |
| 6,394,534 | B1 | | 5/2002 | Dean |
| 6,695,328 | B2 | | 2/2004 | Cope |
| 6,769,733 | B2 | | 8/2004 | Seksaria et al. |
| 6,860,332 | B1 | | 3/2005 | Archer et al. |
| 7,213,872 | B2 | | 5/2007 | Ronacher et al. |
| 7,234,534 | B2 | | 6/2007 | Froland et al. |
| 2005/0099885 | A1 | | 5/2005 | Tamminga |
| 2005/0196269 | A1 | | 9/2005 | Racer et al. |
| 2008/0099213 | A1 | | 5/2008 | Morrow et al. |

FOREIGN PATENT DOCUMENTS

| | | | |
|---|---|---|---|
| DE | 1186334 | | 1/1965 |
| DE | 3620603 | A1 | 1/1987 |
| EP | 0685382 | | 12/1995 |
| EP | 1371391 | B1 | 12/2009 |
| FR | 1471914 | | 3/1967 |
| FR | 2380176 | | 9/1978 |
| GB | 2168015 | A | 6/1986 |
| WO | WO01/76912 | A1 | 10/2001 |
| WO | WO03/049987 | A2 | 6/2003 |
| WO | WO2007/140179 | A2 | 12/2007 |

OTHER PUBLICATIONS

Graphic image of what is understood by Applicants to be a 1938 American LaFrance Duplex from the City of Los Angeles Fire Department in which a first fire pump is mounted in a cowl area of a non-tilt truck cab, and is operated by the chassis engine, and a second fire pump is mounted behind the truck cab, and is operated by another engine mounted in the rear body (1 photograph, one sheet).

Graphic image of what is understood by Applicants to be a Kenworth chassis possibly built by one of Neep, Roney, Howard Cooper, Hiser Bodyworks and/or Western States between the 1950s and the 1980s in which a canopy extending from the rear of a non-tilt truck cab covers a fire pump (1 photograph, one sheet).

Graphic image of what is understood by Applicants to be a late 1930s American LaFrance from the City of Topeka Fire Department in which a fire pump is mounted in a cowl area of a non-tilt truck cab (1 photograph, one sheet).

Graphic images of what is understood by Applicants to be 1969 Western States from the Cornelius and/or Forest Grove Fire Department in which a fire pump is mounted into the front end of a non-tilt truck cab and the chassis is powered by a mid-engine (3 photographs, one sheet).

Graphic images of what is understood by Applicants to be 1993 Western States from the Cornelius Fire Department in which a fire pump is mounted into the front end of a tilt truck cab that does not move when the cab tilts (2 photographs, one sheet).

International Preliminary Report on Patentability for International Application No. PCT/US2007/069433, mail date Nov. 27, 2008, 10 pages.

International Search Report for International Application No. PCT/US2007/069433, mail date Jun. 30, 2008, 4 pages.

Notice of Allowance for U.S. Appl. No. 10/171,414, mail date Oct. 15, 2004, 4 pages.

Notice of Allowance for U.S. Appl. No. 10/923,186, mail date Feb. 26, 2007, 4 pages.

Notice of Allowance for U.S. Appl. No. 11/439,509, mail date Nov. 9, 2009, 5 pages.

Office Action for Application No. EP 03450119, mail date Dec. 27, 2007, 3 pages.

Office Action for Application No. EP 03450119, mail date Mar. 1, 2006, 4 pages.

Office Action for U.S. Appl. No. 10/171,414, mail date Jun. 15, 2004, 5 pages.

Office Action for U.S. Appl. No. 10/923,186, mail date Jun. 21, 2006, 6 pages.

Office Action for U.S. Appl. No. 10/923,186, mail date Oct. 10, 2006, 8 pages.

Office Action for U.S. Appl. No. 11/439,509, mail date Aug. 28, 2009, 15 pages.

Office Action for U.S. Appl. No. 11/439,509, mail date Feb. 26, 2009, 15 pages.

Partial Search Report for Application No. EP 03450119, date of completion Jul. 29, 2003, 4 pages.

Promotional materials for "CBP, AP, and PSD Series Rear Mount Fire Pumps"; Hale Products, Inc., Conshohocken, Pennsylvania; printed from website http://www.haleproducts.com; Rev. 2 dated 2002 (one sheet).

Promotional materials for "RM Series Rear Mount Fire Pumps"; Hale Products, Inc., Conshohocken, Pennsylvania; printed from website http://www.haleproducts.com; Rev. 2 dated 2002 (one sheet).

Promotional materials for "S100 Fire Pump"; Waterous Company, South St. Paul, Minnesota; printed from website http://www.waterousco.com; Rev. dated Dec. 17, 2004 (two sheets).

Response to Office Action for Application No. EP 03450119, mail date Apr. 28, 2008, 30 pages.

Response to Office Action for Application No. EP 03450119, mail date Jun. 27, 2006, 14 pages.

Response to Office Action for U.S. Appl. No. 10/171,414, mail date Sep. 15, 2004, 13 pages.

Response to Office Action for U.S. Appl. No. 10/923,186, mail date Aug. 18, 2006, 14 pages.

Response to Office Action for U.S. Appl. No. 10/923,186, mail date Jan. 8, 2007, 16 pages.

Response to Office Action for U.S. Appl. No. 11/439,509, mail date May 26, 2009, 14 pages.

Response to Office Action for U.S. Appl. No. 11/439,509, mail date Oct. 28, 2009, 13 pages.

Search Report for Application No. EP 03450119, date of completion Oct. 14, 2003, 5 pages.

* cited by examiner

PUMP SYSTEM FOR A FIREFIGHTING VEHICLE

BACKGROUND

The present invention relates generally to the field of firefighting vehicles which are configured to pump or otherwise deliver a firefighting agent or suppressant (e.g., water, foam, etc.) to an area of interest. More specifically, the present applicant relates to the configuration of a pump system (e.g., a fire pump system, etc.) for a firefighting vehicle.

Firefighting vehicles come in a variety of forms. For example, certain firefighting vehicles, known as pumpers, are designed to deliver large amounts of firefighting agents, such as water, foam, or any other suitable fire suppressant to an area of interest. One or more of the firefighting agents may be retrieved from a tank carried by the firefighting vehicle and/or may be retrieved from a source external the firefighting vehicle (e.g., hydrant, pond, etc.). Other firefighting vehicles, known as tankers, are designed to hold and/or transport relatively large quantities of firefighting agents. Still other firefighting vehicles, known as aerials, are designed to additionally elevate ladders or booms. Further still, some firefighting vehicles, known as specialized firefighting vehicles, are designed for responding to unique firefighting circumstances and may be designed for delivering firefighting agents to difficult to reach locations (e.g., airport rescue, etc.).

Regardless of form, a number of firefighting vehicles include pump systems for pressurizing the firefighting agent retrieved from a tank or an external source. Typical firefighting vehicles include a single pump that operates in a relatively narrow pressure window. Because the option of hand-held hose operation is desirable, typical firefighting vehicles include a relatively low pressure pump system. Modern firefighting needs, however, sometimes require the use of multiple pumping pressure levels, combinations of agents, and a great deal of firefighting versatility. More specifically, modern firefighting needs require both the use of very high pressure output levels as well as more conventional lower pressure output levels. For example, it may be desirable to use a high pressure output level to quickly cool or extinguish a large area of fire. This high pressure output may be able to rapidly remove oxygen from the fire, thereby terminating a component of the fire's fuel. Immediately thereafter, it may then be desirable to use a lower pressure output to blanket the area with a fire suppressing foam mixture, for example. Alternatively, it may be desirable for firefighters to switch from high to low pressure flow operation in order to use hand-held nozzles and hoses. The need for firefighting versatility and substantially different fluid pressure output levels presents several design difficulties and challenges.

Some conventional firefighting vehicles only provide a low pressure fluid output. Other conventional firefighting vehicles may provide a high pressure fluid output. Those firefighting vehicles having both a high pressure output and a low pressure output often suffer from a number of problems. For example, firefighting vehicles capable of providing varying water pressure output options typically contain two substantially separate fluid delivery systems, pump systems, and/or waterways, where one system is designed for high pressure operation, and another separate system is designed for low pressure operation. Providing two separate output systems creates a number of difficulties regarding the design, manufacture, and operation of firefighting vehicles. For example, during design, providing two separate fluid delivery systems means an increase in vehicle hydraulics design complexity. In order to facilitate two separate pump systems of different pressure levels, typical firefighting vehicles may have to provide complicated and costly unclutching devices configured to remove mechanical power from a pump. In addition to specific design problems and costs, providing two separate pressure systems often duplicates many parts, generally increasing costs, weight, and power requirements. Significant weight and power increases may render a firefighting vehicle impractical for certain applications. For example, it may be desirable to air transport a firefighting vehicle to a remote location. Conventional firefighting vehicles having two separate pumping systems and/or waterways, and also having high horsepower engines to support the aforementioned systems, are too heavy for many air transport applications. Traditional air transportable firefighting vehicles, on the other hand, have been limited in function and pressure versatility. Ironically, the function and pressure versatility features of an air transportable firefighting vehicle is critical. Backup firefighting capability at a remote location may not be readily available. Furthermore, in the context of an airplane crash, a key use for air-transportable firefighting vehicles, the extreme heat of burning fuel makes rapid cooling and extinguishing via a high pressure output, followed by a low pressure foam blanketing output, for example, critical and highly desirable.

SUMMARY

According to an exemplary embodiment, a firefighting vehicle includes a fluid supply, a first pump stage coupled to the fluid supply and configured to pump fluid at a first pressure, a second pump stage coupled to the first pump stage and configured to pump fluid at a second pressure, the second pressure being substantially different from the first pressure, a fluid manipulator; and a valving arrangement coupling the first pump stage and the second pump stage to the fluid manipulator, the valving arrangement being selectively adjustable between a first position forming a first fluid path and a second position forming a second fluid path, wherein the first fluid path provides the fluid to the fluid manipulator at a first output pressure and the second fluid path provides fluid to the fluid manipulator at a second output pressure.

According to an exemplary embodiment, a firefighting pump system includes a pump having a first pressure stage configured to pump at a first pressure and a second pressure stage configured to pump at a second pressure, the first pressure being substantially different than the second pressure, each pressure stage having an output flow, a conduit system coupled to the pump and defining a first fluid path and a second fluid path, a valving arrangement coupled to the conduit system and configured to selectively control the output flow of the second pressure stage relative to the output flow of the first pressure stage by selectively changing from the first fluid path to the second fluid path.

According to an exemplary embodiment, a method of providing both a high pressure pumping operation and a low pressure pumping operation for a firefighting vehicle includes providing a pump system having a first pressure stage and a second pressure stage, providing the high pressure pumping operation by pumping an output flow from the first pressure stage to the second pressure stage and providing an output flow from the second pressure stage to a fluid manipulator, providing the low pressure pumping operation by pumping substantially all of the output flow from the first pressure stage around the second pressure stage and to the fluid manipulator, allowing at least a portion of the output flow from the first pressure stage to enter the second pressure stage during the low pressure pumping operation; and providing a valving arrangement to selectively change between the high pressure pumping operation and the low pressure pumping operation.

According to an exemplary embodiment, a firefighting pump system includes a low pressure pump stage configured to provide an output flow at a first pressure, a high pressure pump stage configured to provide an output flow at a second pressure, the second pressure being greater than the highest pressure of the low pressure pump stage; and a single conduit system having an input that is in fluid communication with the low pressure pump stage and the high pressure pump stage and an output that is configured to be in fluid communication with a fluid manipulator.

The invention is capable of other embodiments and of being practiced or being carried out in various ways. Alternative exemplary embodiments relate to other features and combinations of features as may be generally recited in the claims.

DETAILED DESCRIPTION

Figure 1:
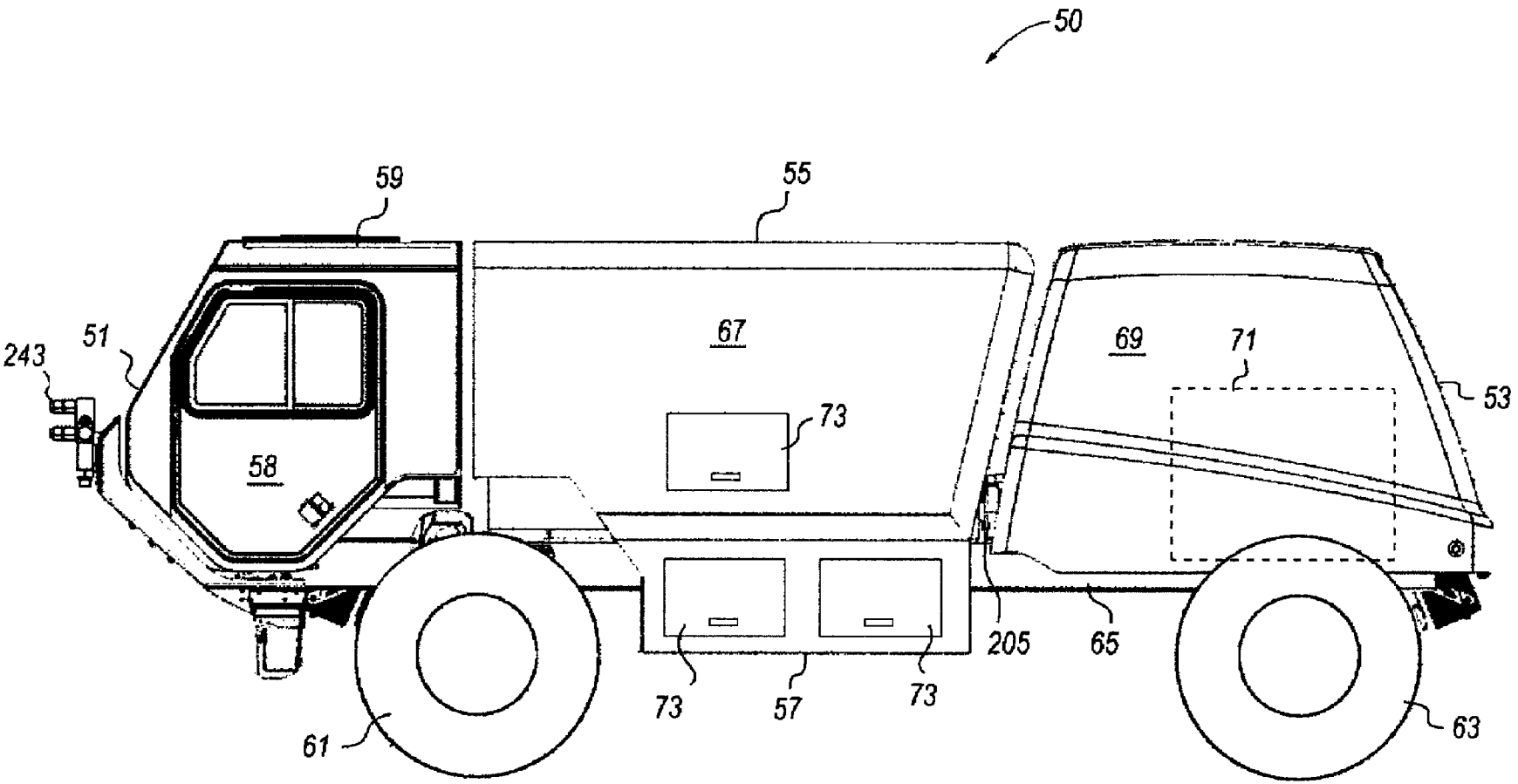
FIG. 1 is a side elevation view of a firefighting vehicle according to an exemplary embodiment.

Referring generally to FIG. 1, a vehicle is shown according to an exemplary embodiment. The vehicle is shown as a firefighting vehicle 50 which is configured to deliver a firefighting agent, such as water, foam, and/or any other fire suppressant to an area of interest (e.g., building, environmental area, airplane, automobile, another firefighting vehicle, etc.) using a vehicle fluid delivery system. Vehicle 50 generally comprises a chassis, a cab supported at a front portion of the chassis, a body supported by the chassis rearward of the cab, a drive system for operating the vehicle and/or one or more systems thereof, and a fluid delivery system. The fluid delivery system generally includes a fluid supply system, a fluid discharge system, a fluid conduit system, and a pump system for pressurizing and/or displacing a firefighting fluid or other agent.

According to one embodiment, the vehicle fluid delivery system of firefighting vehicle 50 is configured to provide at least two substantially different pumping pressure output levels of firefighting agent to an area of interest. Furthermore, the vehicle fluid delivery system is configured to provide at least two substantially different pumping pressure output levels using a relatively common (e.g., shared, single, etc.) fluid supply, waterway or fluid conduit system, and/or fluid discharge system. Providing two substantially different pumping flow pressure levels using a relatively common waterway and related component set may provide a variety of advantages. For example, providing a vehicle having a dual pressure yet common waterway fluid delivery system may allow vehicle 50 to have a greater range of functional firefighting capabilities, may allow the pump system of vehicle 50 to operate more efficiently (thereby reducing the need for a large engine), may provide decreased manufacturing complexity and cost, and/or may provide for a lighter vehicle (thereby allowing the vehicle to be airdropped and improving the maneuverability of the vehicle).

The vehicle fluid delivery system may include a fluid supply system, a pump system, and a fluid discharge system. A firefighting agent is provided to the vehicle fluid delivery system by a fluid supply system. A pump system pressures the fluid or firefighting agent. A fluid discharge system provides for manipulation and expulsion of the fluid. The fluid supply system, pump system, and fluid discharge systems are coupled in fluid communication. A fluid conduit system assists with the coupling of the aforementioned hydraulics systems and the fluidly communicated routing of fluid through the vehicle fluid delivery system. The pump system may include a multistage pump having two substantially different pressure stages. Both pump stages may be powered and configured to experience fluid flow during operation of either high or low pumping flow pressure levels. Fluid flow through both pump stages throughout pump system operation may advantageously keep the pump stages cool during any pumping operation, thereby further eliminating the need to have separate pumps for different pumping pressure levels.

The pump system further includes a valving arrangement that creates two, alternative or otherwise, different flow paths through the pump system. This multiple path configuration made possible by the valving arrangement advantageously allows the vehicle to provide two or more substantially different pressure output levels while maintaining the low cost and high efficiency of a single pressure firefighting vehicle. For example, providing a multiple pressure common waterway firefighting vehicle may allow the vehicle to maintain the weight necessary for air transport while increasing the ways in which the firefighting vehicle may be used. A firefighting vehicle of an exemplary embodiment, for example, may be able to provide a relatively high pressure output level of approximately 1300 pounds per square inch (psi) for some applications, as well as a much lower output level of approximately 175 psi for other applications and using largely the same set of components.

Before discussing the details of the firefighting vehicle 50, it should be noted at the outset that references to "front," "back," "rear," "upper," "lower," "right," and "left" in this description are merely used to identify the various elements as they are oriented in the FIGURES, with "front," "back," and "rear" being relative to the direction of travel of the vehicle. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. In the context of the hydraulics systems used in vehicle 50, coupling generally means coupling components in fluid communication.

Referring further to FIG. 1, vehicle 50 is a self-propelled firefighting vehicle having a front 51, a rear 53, a top 55, a bottom 57 and a pair of opposite sides, including a driver side or left side 58 and a passenger side or right side (not shown). Vehicle 50 is further shown as including a cab 59, motive members 61 and 63, a chassis or frame 65, a forward body portion 67, a rear body portion 69, a drive system 71, and a pump system 205.

Frame 65 supports the functional components of vehicle 50 including, but not limited to, front and rear motive members 61 and 63. Front and rear motive members 61 and 63 generally comprise ground motive members configured to propel or move vehicle 50. According to the embodiment illustrated, motive members 61 and 63 comprise wheels coupled to axles. According to various alternative embodiments, motive members 61 and 63 may comprise any other suitable mechanism for engaging a ground, track, or other surface so as to propel or suspend vehicle 50. For example, motive members 61 and 63 may comprise movable tracks such as commonly employed on tanks and some tractors. Although motive members 61 and 63 are illustrated as being similar to one another, one set of motive members may alternatively be differently configured than motive members 61 and 63. For example, front motive members 61 may comprise wheels while rear motive members 76 may comprise tracks. Additionally, vehicle 50 may be an all-wheel drive vehicle designed to provide driving power to all motive members or all axles of the vehicle. The vehicle 50 may have significant off-road capabilities, and may further be designed for airport rescue services. The size and weight of the vehicle may be optimized for commercial use and/or military use.

Frame 65 generally comprises one or more structures configured to serve as the base or foundation (i.e., support structure) for the remaining components of vehicle 50. Frame 65 extends in a fore and aft direction an entire length of vehicle 50 along a longitudinal center line of vehicle 50. Frame 65 may generally include a pair of parallel longitudinally extending frame members or frame rails which are joined by one or more transversally extending cross members. Frame rails are configured as elongated structural or supportive members (e.g., beams, channels, tubing, etc.). The frame rails are spaced apart in a lateral direction to define a void or cavity. The cavity may provide a space for effectively mounting or otherwise supporting components of vehicle 50. According to various alternative embodiments, frame 65 may have any of a variety of suitable configurations.

Cab 59 is supported by frame 65 and functions as an operator and/or occupant compartment for vehicle 50 by providing an enclosure or area suitable receive an operator and/or occupant of the vehicle. One or more access openings (e.g., doors, etc.) are provided in either, or both, of the left side or right side of vehicle 50 to provide a means for ingress and egress. Although not shown, cab 59 includes controls associated with the manipulation of vehicle 50 (e.g., steering controls, throttle controls, etc.) and may optionally include controls or control systems associated with one or more auxiliary components of the vehicle 50 (e.g., foaming systems, pump systems, aerial ladders, turrets, etc.). According to an exemplary embodiment, cab 59 includes a control system configured to allow the selection of at least two substantially different pumping flow pressures. Cab 59 may also include controls to finely and variably control either of the two or more pumping flow pressures. Cab 59 may also include a bumper turret 243 where the bumper turret 243 is mounted to the front face 51 of the vehicle 50. The front-mounted bumper turret 243 may allow an operator within the cab 59 to manipulate the discharge of firefighting agent or fluid to an area of interest while remaining inside the cab 59. This configuration may advantageously provide some measure of safety for the operators of the vehicle 50 without sacrificing control. In other embodiments, the bumper turret 243 may be mounted to any portion or location of vehicle 50.

Vehicle 50 is further shown as including body portions 67 and 69. Body portions 67 and 69 generally comprise the portion of the vehicle 50 which forms an exterior of vehicle 50 rearward of cab 59 and which is configured for storing or otherwise supporting various components of vehicle 50, such as compressed air form systems ("CAFS"), storage tanks, firefighting equipment (e.g., warning lights, hoses, nozzles, ladders, tools, etc.), and/or for providing an area for supporting one or more emergency response personnel (e.g., firefighters, etc.). Body portions 67 and 69 may be formed of one or more compartmentalized sections having access doors 73 as shown in FIG. 1. According to various alternative embodiments, body portions 67 and 69 may be provided as any number of structures depending on the particular application (e.g., water tank, flat bed, etc.). Body portions 67 and 69 may also contain one or more access doors 73. Access doors 73 may include a body panel, a hinge, and a handle. Access doors 73 may provide access to control panels, compartments, fire hose connectors (inlet and/or outlet fire hose connectors, etc.), fire hoses, general firefighting gear, valves of the pump system, or access to any other system mechanism.

Vehicle 50 also comprises one or more firefighting agent tanks or other containers configured to store one or more firefighting agents such as water, foam, fluid chemicals, dry chemicals, etc. According to an exemplary embodiment, the fluid supply system comprises a relatively large water tank (not shown) and a smaller foam tank. The water tank of the fluid supply system may be configured to hold between approximately 300 gallons of water and approximately 3500 gallons of water, while the foam tank may be configured to hold between 10 gallons of liquid foam concentrate and approximately 300 gallons of liquid foam concentrate. According to an exemplary embodiment, the water tank is a substantially rectangular vessel supported by frame 65 rearward of cab 59 within a body portion 67 and/or 69. According to various alternative embodiments, the storage system may be positioned at other locations of vehicle 50, may have a greater or lesser capacity than those disclosed herein, and may have any of a number of suitable configurations.

To facilitate the operation of vehicle 50 and components thereof, drive system 71 is provided. Drive system 71 of vehicle 50 provides the power to operate vehicle 50 and certain components of vehicle 50 as well as the structure for transmitting the power to one or more motive members 61, 63, and other components of vehicle 50. Drive system 71 generally comprises a power source or prime mover and a motion transfer device. The prime mover, usually an engine, generally comprises a source of mechanical energy (e.g., rotational movement, etc.) which is derived from an energy source (e.g., a stored energy source, etc.). Examples of suitable prime movers include, but are limited to, an internal combustion gas-powered engine, a diesel engine, a turbine, a fuel cell driven motor, an electric motor or any other type of motor capable of providing mechanical energy.

Any of the above mentioned prime movers may be used alone or in combination with one or more additional power sources (as in a hybrid vehicle) to provide mechanical energy. According to one exemplary embodiment, the engine is an internal combustion engine. According to various alternative embodiments, the drive system 71 may be selected from any suitable prime mover that is, or may become, commercially available, or the prime mover may be specifically configured for use with vehicle 50.

The motion transfer device (e.g., a transmission, etc.) is coupled to a first power output of the engine and ultimately (in combination with other components) transfers the power and rotational mechanical energy received from the engine to motive members 61, 63, which in turn propel vehicle 50 in a forward or rearward (or other) direction. The transmission may be coupled, directly or indirectly, to motive members 61, 63, a wheel end reduction unit, and/or a series of motion transfer devices such as shafts, joints, differentials, etc. that are coupled together to transfer the power or energy provided by the engine to the motive members 61, 63. The transmission may be any of a variety of suitable transmissions (e.g., standard, split shaft, etc.). According to one exemplary embodiment, the transmission is an automatic transmission.

According to an exemplary embodiment, the engine further comprises a second power output. The second power output is configured to provide rotational mechanical energy whenever the engine is providing rotational mechanical energy. The second power output may be a power take-off device (e.g., power divider, etc.). The power take-off device may be a drive which comprises a source of rotational energy (secondary to the primary crankshaft) for operating one or more components of vehicle 50. The power take-off device may operate whenever the engine is operating (i.e., while moving the truck or not). Moreover the power take-off device may provide power to one or more components of vehicle 50 regardless of engine speed. According to an exemplary embodiment, the power take-off device (e.g., power divider, etc.) is used to drive the components and subsystems of vehicle fluid delivery system 201, including especially pump system 205. According to various other embodiments, vehicle fluid delivery system 201 may be driven by any other suitable source of energy including, but not limited to, a secondary motor.

Vehicle fluid delivery system 201 is generally located in the middle of the vehicle 50 and may be located outside of the left hand frame-rail underneath the water tank. Components relating to the vehicle fluid delivery system are scattered throughout the body, cab, and frame of vehicle 50. According to other exemplary embodiments, fluid delivery system 201 and pump 205 are located at any position on the vehicle 50 and may exist at any location relative to the frame 65, cab 59, and body portions 67, 69. Pump system 205 is shown in the exemplary embodiment of FIG. 1 as being located approximately between front body portion 67 and rear body portion 69, and is installed on the frame 65.

Figure 2:
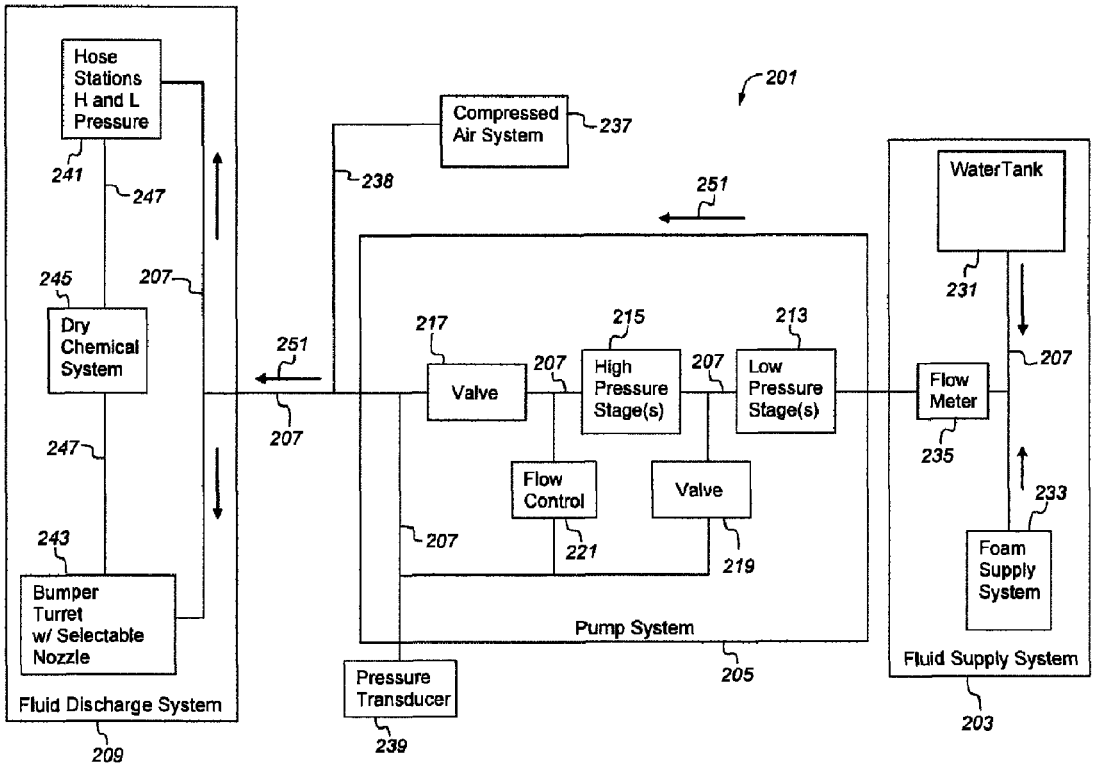
FIG. 2 is a block diagram of the fluid delivery system of the firefighting vehicle of FIG. 1, according to an exemplary embodiment, the block diagram showing the general flow through the fluid delivery system.
Figure 3:
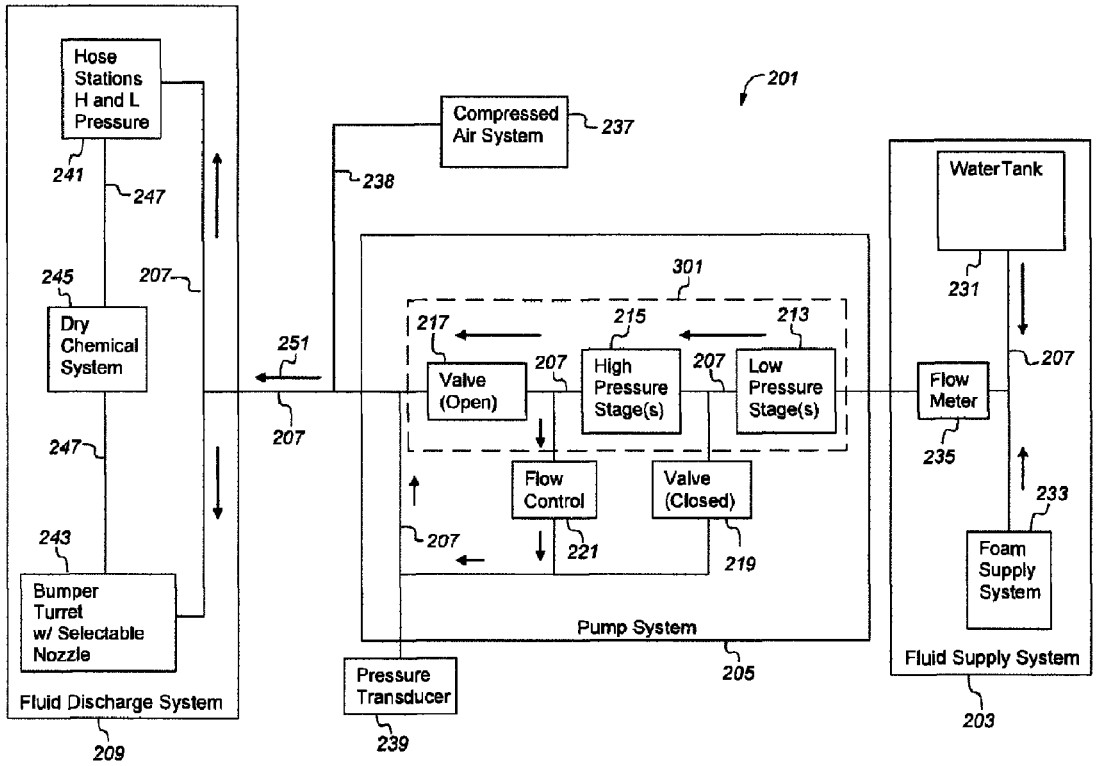
FIG. 3 is a block diagram of the fluid delivery system of the firefighting vehicle of FIG. 1, according to an exemplary embodiment, the block diagram showing the series or high pressure mode of operation.
Figure 4:
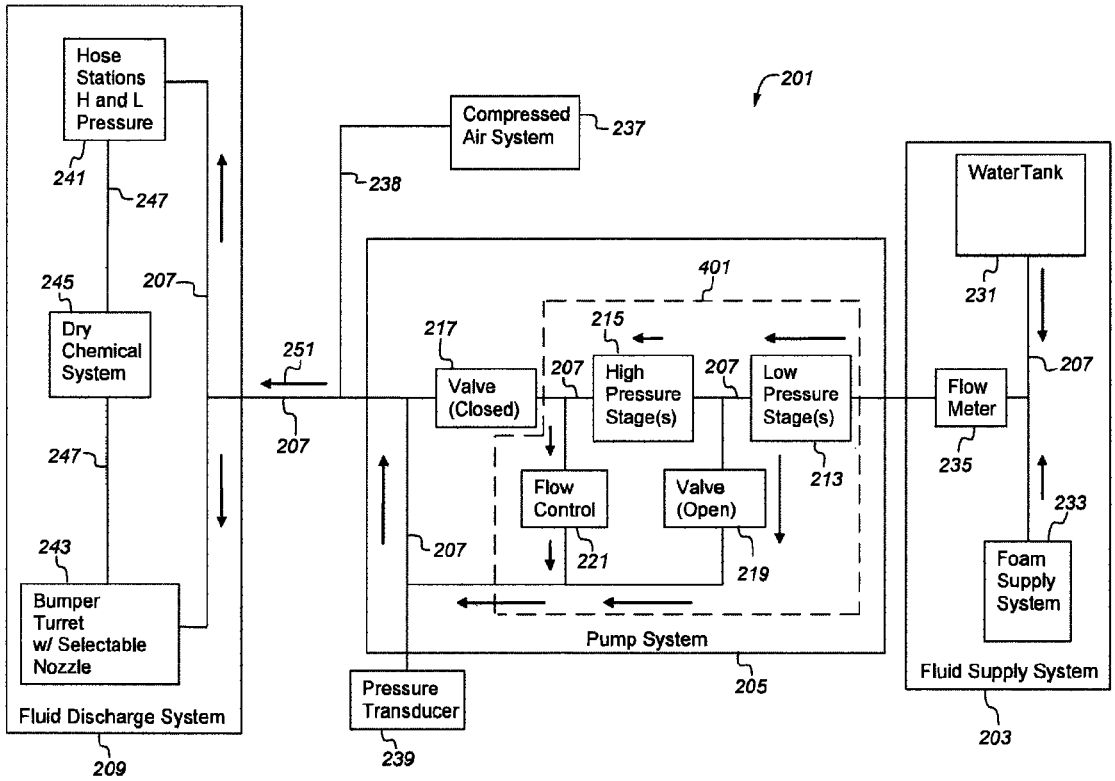
FIG. 4 is a block diagram of the fluid delivery system of the firefighting vehicle of FIG. 1, according to an exemplary embodiment, the block diagram showing the parallel or low pressure mode of operation.

Referring to FIGS. 2-4, and according to an exemplary embodiment, vehicle fluid delivery system 201 is a fluid delivery system configured to pressurize and pump the firefighting fluid or agent from a firefighting source (e.g., fluid supply, tank, body of water, hydrant, etc.) so that the pressurized firefighting agent can be supplied to various manipulators or fluid outlets (e.g., hose connectors, manifolds, turrets, fluid discharge systems, etc.) of vehicle 50. According to an exemplary embodiment, fluid delivery system 201 is configured to pump up to at least about 2,000 gallons of firefighting agent per minute. According to other exemplary embodiments, and often depending on the application, vehicle fluid delivery system 201 will provide between 10 and 500 gallons of firefighting agent per minute. According to various alternative embodiments, vehicle fluid delivery system 201 may have flow rates greater or less than those provided above. Firefighting fluid delivery system 201 generally comprises a fluid supply system 203, a pump system 205, a fluid conduit system 207, and a fluid discharge system 209.

Fluid conduit system 207 generally directs the flow of firefighting fluid or agent to and from the various fluid delivery system 201 components of vehicle 50. Fluid conduit system 207 may constitute any combination of conduits (e.g., piping, plumbing, routing, etc.) configured to direct the flow of fluid into and out of the fluid inlets and or fluid outlets of the components of the fluid delivery system 201. Fluid conduit system 207 facilitates the coupling of the components of fluid delivery system 201 in fluid communication. Fluid conduit system 207 is not limited to physical components such as conventional pipes, but may also consist of any hollow space that may route the fluid of the fluid delivery system 201 through the hydraulics components of vehicle 50. Furthermore, fluid conduit system 207 may be of any past, present, or future design that is capable of coupling hydraulic components and providing for fluid communication between and through components. According to an exemplary embodiment, fluid conduit system 207 is a single conduit system having an input that is in fluid communication with pump system 205 and an output that is configured to be in fluid communication with a fluid manipulator 209. According to an exemplary embodiment, only one output path or single conduit system path exists between the output of the pump system and the fluid discharge system 209.

Fluid supply system 203 (i.e., fluid supply, liquid supply, firefighting agent supply, etc.), is shown as comprising a water tank 231, a foam supply system 233, and a flow meter 235. The components of fluid supply system 203 are generally coupled by and to the fluid conduit system 207. While the fluid supply system 203 is shown in the FIGURES as a water tank system 231, fluid supply system 203 may be any system configured to draw or supply any fluid from a fluid source (e.g., a body of water, a fire hydrant, a tank external the vehicle, another truck, etc.). According to an exemplary embodiment, the fluid of fluid supply system 203 and of the larger fluid delivery system 201 is a liquid (or substantially liquid) firefighting agent capable of directly suppressing fires. Foam supply system 233 may by any system designed to inject foam or some mixture of foam into the fluid conduit system 207. This foam mixture may be a fire suppressant chemical, and the foam mixture may work with the pumping system to provide an output blanket that keeps oxygen off the fire source. In addition to separating the air, a fuel for the fire, from the source of fire, the blanket of foam may also hold the water previously sprayed into the target area in place. According to an exemplary embodiment, the foam supply system 233 injects foam concentrate formulated to suppress fires. A low pressure foam stage may be desirable for a variety of reasons. The fluid supply system (and the water tank 231 and foam supply system 233) may include any number of features of any past, present, or future design capable of supplying fluid to the vehicle fluid delivery system 201.

Fluid discharge system 209 may comprise one or more fluid manipulators (e.g., outputs, hoses, nozzles, turrets, holes, openings, orifices, spouts, etc.) designed to output or direct the fluid away from the vehicle 50. According to an exemplary embodiment, fluid discharge system 209 comprises hose stations 241, bumper turret 243, and dry chemical system 245. Fluid conduit system 207 couples the rest of the vehicle fluid delivery system 201 to the fluid discharge system 209 and provides the fluid flow and fluid routing through the fluid discharge system 209. Hose station 241 may include any number of hose reels. According to an exemplary embodiment, the hose station 241 includes a high pressure hose reel (and accompanying nozzle and other controls) and a low pressure hose reel (and accompanying nozzle and other controls). The hose reels of the hose station 241 may be designed for different purposes in addition to pressures. For example, the low pressure hose reel may be designed to output water, low pressure compressed air foam (CAFS), compressed nitrogen dry chemical, or a combined agent (CAFFS), perhaps a dry chemical and low pressure water and foam solution. Bumper turret with selectable nozzle 243 may similarly comprise any number of nozzles of multiple pressures and intended functions. For example, according to an exemplary embodiment, the bumper turret 243 includes both a low pressure nozzle and a high pressure nozzle. Dry chemical, water, foam, and other agents or mixtures may be output through any nozzle of the bumper turret 243. The dry chemical system 245 is coupled to the components of the fluid discharge system 209 via dry chemical conduit 247. Fluid discharge system 209 may additionally comprise any number of user switches, valves, or other controls meant to facilitate switching between nozzles and high and low pressure operation. Moreover, according to one embodiment, vehicle 50 advantageously provides the ability to switch between varying pressure levels (e.g., substantially different pressure levels, etc.) from the control system of operator cab 59 without un-clutching a pump or powering a pump down. The fluid discharge system 209 may be of any past, present, or future design capable of manipulating a fluid output from vehicle 50.

According to an exemplary embodiment, vehicle fluid delivery system 201 includes a compressed air system 237. Compressed air system 237 pumps air into the vehicle fluid delivery system 201 to aid in accelerating and expanding the fluid spray from the manipulator outputs 241, 243 of the fluid discharge system 209. The compressed air system 237 includes an air compressor, an air routing system, an automatic pressure control circuit, and adjustable manual control valve that bypasses the automatic control circuit. Oil of the system and/or vehicle 50 may be filtered and cooled by water circulation through an oil to water cooler. The air compressor, according to an exemplary embodiment, has a flow of around approximately 200 standard cubic feet per minute (SCFM) at 170 psi for 3.0 minutes and provides up to at least a 6:1 expansion ratio. Because the water of vehicle fluid delivery system 201 is under varying amounts of pressure, the compressed air system 237 must be able to at least match the water pressure. According to an exemplary embodiment, the automatic control circuit of the compressed air system 237 automatically matches the air pressure of the compressed air system 237 to the water pressure of the vehicle fluid delivery system 201.

According to an exemplary embodiment, vehicle fluid delivery system 201 includes a pressure transducer 239 coupled to the system. Pressure transducer 239 converts pressure into an analog (or digital) signal for further output to electronics devices and/or other control circuits or displays. For example, the pressure transducer 239 may be communicably connected to the automatic control circuit of the compressed air system 237 to facilitate the pressure matching features of the compressed air system 237. Pressure transducer 239 may be located at any location or multiple locations throughout the vehicle fluid delivery system 201. According to an exemplary embodiment, pressure transducer 239 communicates the pressure of the vehicle fluid delivery system 201 to an operations panel within the vehicle cab 59 and is located near the output of pump system 205.

Pump system 205, according to an exemplary embodiment, comprises a valving arrangement (e.g., valves 217, 219, flow control 221), a fluid conduit system 207, a first pump stage (shown as a low pressure pump stage 213), and a second pump stage (shown as a high pressure pump stage 215). Fluid generally flows through the pump system 205 in the direction of flow arrows 251 as shown in FIG. 2. The fluid supply system 203 is coupled to the low pressure stage 213 of the pump system 205 via fluid conduit system 207. After fluid has passed through the low pressure pump stage 213, fluid may flow through high pressure stage 215 and/or through valve 219. Similarly, after fluid has passed through high pressure stage 215 it may flow through valve 217 and/or flow control 221. Flow from valve 217, valve 219, and flow control 221 is directed out of the pump system 205. Fluid output from the pump system 205 is then directed via the fluid conduit system 207 to the fluid discharge system 209. It should be noted that the first pump stage (e.g., low pressure stage 213) and/or the second pump stage (e.g., high pressure stage 215) may be formed of one or more pump stages. For example, the pump system 205 may be a six stage pump system wherein four stages form the high pressure stage 215 and two stages form the low pressure stage 213. According to another exemplary embodiment, high pressure stage 215 is formed of at least three pump stages.

Pump stages 213 and 215 of pump system 205 may comprise a wide variety of pump technologies. According to an exemplary embodiment, a pump stage is any component or components capable of pumping fluid. According to an exemplary embodiment, pump system 205 includes a single centrifugal multistage pump having a low pressure stage 213 and a high pressure stage 215. According to other exemplary embodiments, pump system 205 may include more than one physical pump and/or more than two pump stages. Furthermore, pump system 205 may include pumps or pump stages of any type and include any number of pumping technologies. The high pressure pump stage 215 and the low pressure pump stage 213 are configured to pump substantially different pressure levels. For example, the high pressure pump stage 215 may be configured to pump a pressure of at least double the highest pressure the low pressure pump stage 213 is configured to pump. According to an exemplary embodiment, vehicle 50 and pump system 205 may include at least one high pressure pump stage 215 capable of delivering up to at least between approximately 600 psi and 1500 psi. According to another exemplary embodiment, the high pressure pump stage 215 provides up to at least between approximately 1000 psi and 1300 psi. According to yet another exemplary embodiment, the high pressure pump stage 215 is a high pressure pump stage specified to output approximately 1300 psi. On the other hand, according to an exemplary embodiment, vehicle 50 and pump system 205 include at least one low pressure pump stage 213 capable of delivering up to at least between approximately 10 psi and 250 psi. According to another exemplary embodiment, low pressure pump stage 213 is pressure variable at the control system of the vehicle 50 or at the fluid manipulators 241, 243, etc. According to yet another exemplary embodiment, the low pressure pump stage 213 is a low pressure pump stage specified to output approximately 160 psi. The flow of range of the pump system 205 and pump stages 213 and 215, according to an exemplary embodiment, is between 250 and 400 gallons per minute. The pump stages 213 and 215 may be a device or devices of any past, present, or future design capable of pumping a fluid.

Referring to FIG. 3, a first fluid path (e.g., a high pressure pump mode, etc.), shown as a series flow path 301, is shown according to an exemplary embodiment. Series flow path (conduit path) 301 is created by the actuation of a valving arrangement of the pump system 205. More specifically, series flow path 301 is created when the fluid output from the first stage (e.g., low pressure stage 213) is allowed to flow through the second stage (e.g., high pressure stage 215) without being substantially restricted from flowing therethrough. When substantially the entire flow of low pressure stage 213 is allowed to then flow through high pressure stage 215, the pump system 205 of vehicle 50 operates in a high pressure (series) mode 301.

Referring now to FIG. 4, a second fluid path (e.g., a low pressure pump mode, etc.), shown as a parallel flow path 401, is shown according to an exemplary embodiment. Parallel flow path (conduit path) 401 is created by the actuation of a valving arrangement of the pump system 205. More specifically, parallel conduit path 401 is created when the fluid output from the first stage (e.g., low pressure stage 213) is at least partially restricted (e.g., substantially restricted, etc.) from flowing through the second stage (e.g., high pressure stage 215). Parallel flow path 401 allows a restricted amount of fluid to flow through the high pressure stage 215 while some of the flow from low pressure stage 213 bypasses the high pressure stage. When a substantial amount of the fluid flow out of the low pressure stage 213 bypasses the high pressure stage 215, the pump system 205 of vehicle 50 operates in low pressure (parallel) mode 401. For the purposes of this disclosure, the term bypass is used broadly to refer to any situation wherein an amount of fluid exiting low pressure stage 213 avoids flowing through high pressure stage 215. Rather than flowing through high pressure stage 215, the bypassed fluid is directed through a different flow path to the fluid discharge system 209. According to an exemplary embodiment, between approximately 75 percent and 95 percent of the fluid flow through low pressure stage 213 bypasses high pressure stage 215 on its path to the fluid discharge system 209.

Referring to FIGS. 3 and 4, according to an exemplary embodiment, the two alternate or otherwise different fluid flow paths (series and parallel) are achieved by actuating at least valves 217 and 219. For example, referring to FIG. 3, in high pressure (series) mode, the series fluid flow path 301 is created by closing valve 219 and opening valve 217. When valve 219 is closed and 217 is open, flow from low pressure stage 213 may continue through high pressure stage 215 and out of pumping system 215. Referring to FIG. 4, in low pressure (parallel) mode, parallel fluid flow path 401 is created by opening valve 219 and closing valve 217. When valve 219 is open and valve 217 is closed, flow through high pressure stage 215 is substantially restricted relative to the flow through low pressure stage 213 and the remainder of the flow out of low pressure stage 213 bypasses high pressure stage 215 by flowing through open valve 219.

Referring still to FIGS. 3 and 4, according to an exemplary embodiment, flow control 221 is configured to substantially restrict the fluid flow through the high pressure stage 215 in low pressure (parallel mode). In high pressure mode, however, some fluid flow still flows through flow control 221. In low pressure mode, this flow through high pressure stage 215 gives high pressure stage 215 its output "parallel" to the output of low pressure stage 213. In other words, in low pressure (parallel) mode, the two pump stages 213 and 215 both directly provide fluid flow to the output of pump system 205. In low pressure mode, high pressure stage 215 provides a fluid flow out of pump system 205 via flow control 221 and the low pressure stage 213 provides a fluid flow out of pump system 205 via valve 219. On the other hand, in high pressure (series) mode, substantially the entire output flow from low pressure stage 213 is sent in succeeding order to and through high pressure stage 215. According to an exemplary embodiment, when in low pressure (parallel) mode (FIG. 4), flow control 221 and the valving arrangement 217, 219 substantially restrict the flow coming into pumping system 205 from flowing through high pressure pump stage 215. For example, flow control 221 and valving arrangement 217, 219 may prevent up to approximately 95 percent of the flow coming into pumping system 205 from flowing through the high pressure pump stage 215. According to another exemplary embodiment, flow control 221 and valving arrangement 217, 219 may restrict more than 95 percent of the flow coming into pumping system 205 from flowing through high pressure pump stage 215. According to another exemplary embodiment, between approximately 15 percent and 25 percent of the flow sent into the pumping system 205 flows through the high pressure pump stage 215.

According to an exemplary embodiment, flow control 221 advantageously allows the high pressure pump stage 215 to remain powered and pumping while the system is operating in low power mode by providing at least a cooling flow through high pressure stage 215. Without a fresh supply of fluid, or an active fluid flow, pumps, particularly high pressure pumps and/or high pressure pump stages, may rapidly overheat if not powered down. A function of the flow control 221 is to provide a constant "fresh" fluid flow through the high pressure stage 215, even when operating in low pressure mode, to prevent overheating of the high pressure stage 215.

The valving arrangement (217, 219, 221, etc.) of the pump system 205, advantageously allows the vehicle 50 to provide two substantially different pumping flow pressures with a substantially common waterway (fluid conduit system, pump system, fluid supply, fluid discharge system, electronics, controls, etc). This common or singular set of components may advantageously reduce the cost of the firefighting vehicle, reduce the weight of the vehicle, maintain a relatively low hydraulics system complexity level, and allow the pump system 205 to operate efficiently during either a high pressure or low pressure operation mode. According to an exemplary embodiment, fluid conduit system 207 is a common waterway or single conduit system having an input that is in fluid communication with low pressure pump stage 213 and high pressure pump stage 215 and an output that is configured to be in fluid communication with fluid manipulator 209. According to an exemplary embodiment, vehicle 50 includes a single conduit system where the flow through pump stage 213 and pump stage 215 is provided by the same fluid supply 203 and substantially the same conduit system 207, and is provided to the same fluid discharge system 209.

Advantageously, the valving arrangement of the pump system 205 prevents the operators of firefighting vehicle 50 from having to unclutch or disengage a pump or pump stage from the system. The components necessary to unclutch or disengage a pump or pump stage are costly and complex. Moreover, by restricting flow through a pressure stage of a pump (e.g., high pressure stage), a centrifugal pump (for example) may draw less power from the power delivery system 71. Thus, according to the exemplary embodiments shown in FIGS. 2-5, low pressure mode increases pump system 205 efficiency. This, advantageously, gives the power system or engine 71 some overhead for secondary applications when operating in low pressure mode. For example, the saved power of the low pressure mode shown in FIG. 4 may allow the vehicle 50 and drive system 71 to power up and use the compressed air system 237. According to one exemplary embodiment, for example, the pump system 205 may draw approximately 400 horsepower when operating in high pressure mode (FIG. 3). When the flow through the high pressure stage is restricted, and low pressure mode is activated (FIG. 4), the horsepower draw of the pump system 205 may drop to approximately 330 horsepower. This difference between high pressure and low pressure mode (e.g., approximately 70 horsepower) may allow, for example, an approximately 70 horsepower air compressor to run while the pump system 205 is operating in low pressure mode (FIG. 4). Thus, rather than enlarging the size of the engine 71 and/or adding other power system components, vehicle 50 may include a smaller and lighter drive system 71 relative to conventional firefighting vehicles.

Figure 5:
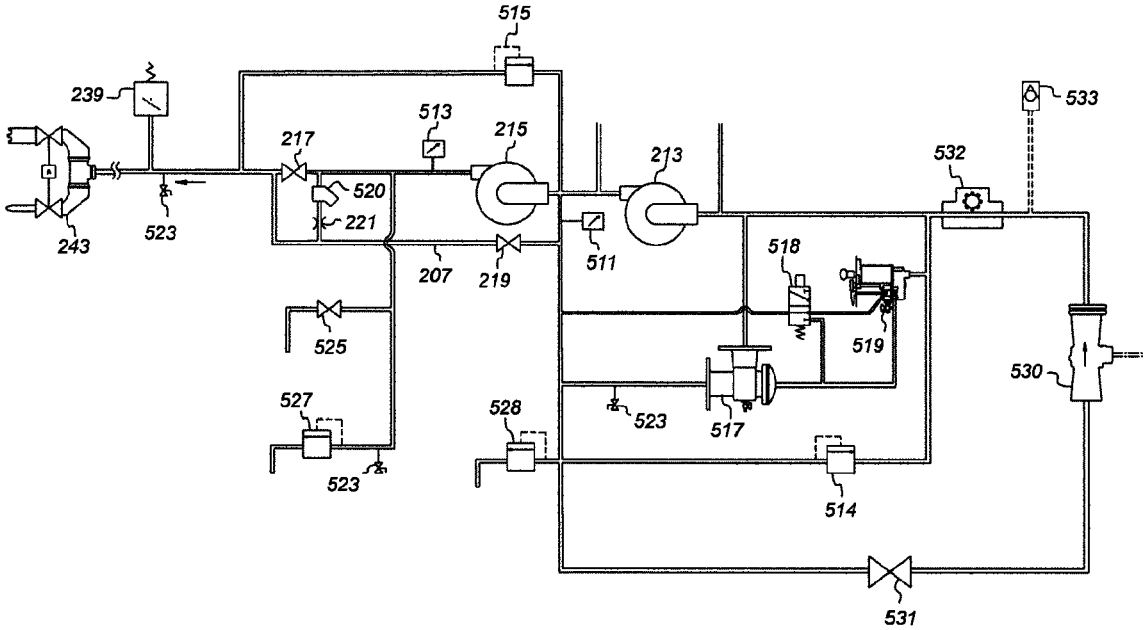
FIG. 5 is detailed schematic of the pump system of FIGS. 2-4 according to an exemplary embodiment.

FIG. 5 shows a detailed schematic view of the pump system 205 according to an exemplary embodiment. Pump system 205 includes low pressure pump stage 213 and high pressure pump stage 215 which may eventually provide pumping flow to bumper turret 243. Bumper turret 243, as shown, may include two separate nozzles that may be selected for fluid output. In this embodiment, low pressure pump stage 213 and high pressure pump stage 215 are shown as separate pumps but (as detailed above) they may be provided as a single multistage pump. According to an exemplary embodiment, water is provided through check valve 533 from water tank 231 and foam concentrate is supplied to foam eductor 530 from foam supply 233. In addition to the components shown in FIGS. 2-4, the pump system shown in FIG. 5 displays a variety of protection and control mechanisms on a variety of conduit lines within the pump system. For example, prior to the low pressure stage 213 and after the fluid supply system 203, the pump system 205 includes a relief valve 517, a pressure relief selection valve 518, an adjustable pilot valve 519, a pressure relief valve 514, and one or more safety relief valves 528. These valves function to relief out of the system altogether or to relief back to the suction side of the low pressure pumping stage 213. Throughout the pump system 205 a series of drains 523 are shown. According to an exemplary embodiment, drains 523 are manual drains that allow flushing and maintenance of the pump system 205. In any mechanical pump system, and especially in a pump system 205 having a high pressure pump or pump stage 215, heat presents a potential issue. Thus, pump system 205 includes at least two overheat thermostats 511 and 513. According to an exemplary embodiment, overheat thermostats 511 and 513 are 180 degree thermostats. Overheat thermostat 511 is located on a fluid conduit portion after the output from low pressure stage 213. When located in this manner, overheat thermostat 511 primarily senses an overheat condition within low pressure stage 213. Similarly, overheat thermostat 513 is located on a fluid conduit portion after the output from the high pressure stage 215. When located in this manner, overheat thermostat 513 primarily senses an overheat condition within high pressure stage 215.

Pumping system 205 may additionally include one or more additional pressure and/or temperature relief valves and/or other relief devices strategically located around the system. For example, according to an exemplary embodiment, pressure relieve valves may exist prior to the input to low pressure pump stage 213 (e.g., pressure relief valves 517 and 519, etc.), may exist between the pumping stages 213 and 215 (e.g., safety relief valve 528, etc.), and/or may exist after the output of both stages (e.g., pressure relief valve 527, etc.).

According to the exemplary embodiment shown in FIG. 5, valves 217 and 219 are electronically controlled valves. In other embodiments, valves 217 and 219 may be automatically controlled valves, mechanically controlled valves, or manually controlled valves. It is important to note, however, that valves 217 and 219 may be any valve or other flow control device that may change state to provide at least two fluid flow levels. Valves 217 and 219 may be any type of valve (e.g., simple shutoff, a precision control, angle, ball, block and bleed, check, control, cartridge, directional, drain, needle, poppet, pressure relief, safety, shut off, solenoid, spool, stack mounted, etc.). Valves 217 and 219 may be of the same types or different types. According to the exemplary embodiment shown in FIG. 5, valves 217 and 219 are electronically controlled shut-off valves and either provide a full flow state or a no flow state. Valves 217 and 219 are configured to have opposite normal states (i.e., normally open v.s. normally closed). For example, valves 217 and 219 are configured to be simultaneously and alternatively actuated such that as one valve of 217 and 219 is closing, the other is opening. This alternative actuation provides may provide a binary nature of the fluid flow paths (301 and 401) and pump stage configuration that allows the dual pressure function of the firefighting vehicle 50.

Flow control 221, as shown in the exemplary embodiment of FIG. 5, is a fixed orifice. However, according to other exemplary embodiments, flow control 221 may be any type of hydraulics device that may be configured to provide a specific amount of flow restriction (e.g., restrictor valves, variable flow restrictors, flow meter, flow, etc.). According to an exemplary embodiment, a strainer 520 exists prior to flow control 221 to prevent blockage of flow control 221. The flow control 221 may be of any past, present, or future design and/or materials capable of providing a specific amount of flow restriction.

According to the exemplary embodiment shown in FIG. 5, foam eductor 530, foam induction shut off valve 531, and solution flow meter 532 are coupled in fluid communication and controllably provide foam from the foam supply system 233 to the pump system 205. Foam educator 530, foam induction shut off valve 531, and solution flow meter 532 may be coupled to an electronic foam control system (not shown) and/or further coupled to an operator control system (not shown) located in the front cab 59 or otherwise. Actuating the foam induction shut off valve 531 will either provide or deprive a water (or substantially water) flow through foam eductor 530. When a flow is provided through foam eductor 530 a vacuum on a foam concentrate input pulls foam concentrate from a foam supply system 233. Flow meter 532 measures flow and provides an electrical signal of the measured flow to at least one control system. While the above foam providing components 530, 531 and 532 are shown in FIG. 5, vehicle 50 may have no foam providing components or have foam providing components of any past, present, or future design and/or materials capable of providing and/or mixing foam into the pump system 205.

According to another exemplary embodiment, a method may be provided for switching from high pressure pumping operation (FIG. 3) to low pressure pumping operation (FIG. 4) in a vehicle 50. High pressure pumping operation (FIG. 3) may include providing a pump having a first pressure stage 213 and a second pressure stage 215, wherein a fluid flow is provided to the first pressure stage, usually from a multi-fluid fluid supply 203. High pressure operation is further provided by pumping the majority of the fluid flow from the first pressure stage 213 through the second pressure stage 215. Furthermore, high pressure operation includes providing a majority of the fluid flow output from the second pressure stage 215 to a fluid manipulator 209. The method may further comprise an operator of the firefighting vehicle 50 commanding a control system to switch from high pressure operation (FIG. 3, generally) to low pressure operation (FIG. 4, generally). Switching from high pressure operation to low pressure operation (FIG. 4) includes substantially restricting the fluid flow through the second pressure stage 215 relative to the first pressure stage 213 and routing the fluid flow output from the first pressure stage substantially around the second pressure stage 215 and to the fluid manipulator 209 via the valving arrangement and accompanying flow paths of the FIGS. 2-4.

According to an alternative embodiment, a method of providing both a high pressure pumping operation and a low pressure pumping operation for a firefighting vehicle includes providing a pump system having a first pressure stage 213 and a second pressure stage 215, providing the high pressure pumping operation (FIG. 3) by pumping an output flow from the first pressure stage 213 to the second pressure stage 215 and providing an output flow from the second pressure stage 215 to a fluid manipulator 209; providing the low pressure pumping operation (FIG. 4) by pumping substantially all of the output flow from the first pressure stage 213 around the second pressure stage 215 and to the fluid manipulator 209, allowing at least a portion of the output flow from the first pressure stage 213 to enter the second pressure stage 215 during the low pressure pumping operation (FIG. 4), and providing a valving arrangement 217, 219 to selectively change between the high pressure pumping operation (FIG. 3) and the low pressure pumping operation (FIG. 4).

Overall, vehicle 50 is a firefighting vehicle capable of providing two or more substantially different pumping pressure levels using a relatively common waterway and other set of components. Because vehicle 50 includes a relatively common waterway and set of components, and is capable of providing two or more substantially different pumping pressure levels, vehicle 50 may be lighter, more versatile, more energy efficient, more functional, and more maneuverable than conventional firefighting vehicles. Because vehicle 50 and pump system 205 provide an efficient low pressure mode, the engine horsepower requirements may be lowered and a lighter engine used. Because pump system 250 is able to provide a high pumping pressure followed by a low pumping pressure without manual changeover, vehicle 50 may be used more effectively to extinguish fires. Because pump system 250 is more efficient in low pressure mode, the engine may have power headroom available to power a compressed air system 237, a foam supply system 233, and/or a dry chemical system 245 without expensively providing and unclutching a pump or pump stage. Although each of the aforementioned features and benefits have been described as being utilized in conjunction with one another as part of firefighting vehicle 50, such features may alternatively be used independent of one another and may be used on other vehicles including those used for firefighting or other purposes.

It is important to note that the construction and arrangement of the elements of vehicle 50 and/or vehicle fluid delivery system 201 as shown in the exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the firefighting vehicle may be constructed from any of a wide variety materials that provide sufficient strength or durability, in any of a wide variety of colors, textures and combinations. Accordingly, all such modifications are intended to be included within the scope of the present inventions. Other substitutions, modifications, changes and omissions may be made in the design, operating conditions and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims.

What is claimed is:

1. A firefighting vehicle comprising:

a fluid supply;

a first pump stage coupled to the fluid supply and configured to pump fluid at a first pressure;

a second pump stage coupled to the first pump stage and configured to pump fluid at a second pressure, the second pressure being substantially different from the first pressure;

a fluid manipulator; and a valving arrangement coupling the first pump stage and the second pump stage to the fluid manipulator, the valving arrangement being selectively adjustable between a first position forming a first fluid path and a second position forming a second fluid path, wherein the first fluid path provides the fluid to the fluid manipulator at a first output pressure and the second fluid path provides fluid to the fluid manipulator at a second output pressure;

wherein the first and second positions of the valving arrangement allow fluid to flow from the output of the first pump stage through the second pump stage and wherein the valving arrangement is configured to allow both the first pump stage and the second pump stage to remain pumping regardless of whether the first fluid path or the second fluid path has been selected;

wherein the first fluid path directs the fluid output from the first pump stage through the second pump stage; and wherein the second fluid path directs a portion of the fluid output from the first pump stage around the second pump stage and restricts the flow of fluid through the second pump stage while allowing some fluid to flow through the second pump stage and for the second pump stage to remain pumping.

2. The firefighting vehicle of claim 1, wherein at least one of the first pump stage and the second pump stage is formed of more than one pump stage.

3. The firefighting vehicle of claim 2, wherein the second pump stage is formed of at least 3 pump stages.

4. The firefighting vehicle of claim 1, wherein the first pump stage and the second pump stage are pump stages of a multistage pump.

5. The firefighting vehicle of claim 1, wherein the fluid manipulator comprises a turret mounted at a front end of the vehicle.

6. The firefighting vehicle of claim 5, wherein the turret comprises at least two output nozzles, wherein a user may select between at least a high pressure nozzle and a low pressure nozzle.

7. The firefighting vehicle of claim 6, further comprising a dry chemical system coupled to the turret.

8. The firefighting vehicle of claim 1, wherein the first and second pump stages are substantially in series when the valving arrangement is selectively adjusted to form the first fluid path; and wherein the first and second pump stages are partially in parallel when the valving arrangement is selectively adjusted to form the second fluid path.

9. The firefighting vehicle of claim 8, wherein the first fluid path provides a high pumping pressure.

10. The firefighting vehicle of claim 8, wherein the second pump stage is a high pressure pump stage.

11. The firefighting vehicle of claim 10, wherein the second fluid path substantially restricts fluid flow through at least one of the first pump stage and the second pump stage.

12. The firefighting vehicle of claim 11, wherein the second fluid path substantially restricts the fluid flow through the high pressure pump stage.

13. The firefighting vehicle of claim 12, wherein the fluid that flows through the high pressure pump stage while the low pressure pump stage is pumping fluid is sufficient to cool the high pressure pump stage.

14. The firefighting vehicle of claim 13, wherein both the first and second pump stages pump fluid regardless of whether the valving arrangement is in the first position or the second position.

15. The firefighting vehicle of claim 1, further comprising an electronic control system configured to actuate the valving configuration.

16. The firefighting vehicle of claim 1, further comprising a multi-fluid fluid supply.

17. The firefighting vehicle of claim 16, further comprising a compressed air system coupled to the fluid manipulator.

18. The firefighting vehicle of claim 17, further comprising a foam supply system coupled to the fluid supply system.

19. The firefighting vehicle of claim 1, wherein the valving arrangement comprises a first valve downstream of the first pump stage; and wherein the valving arrangement further comprises a second valve downstream of the second pump stage.

20. The firefighting vehicle of claim 19, wherein the valving arrangement is located upstream of a fluid discharge system and a compressed air system.

21. The firefighting vehicle of claim 19, wherein the second fluid path directs fluid flow from the first pump stage substantially around the second pump stage and the second valve.

22. The firefighting vehicle of claim 19, wherein the first valve and the second valve are controlled to be alternatively opened and closed to create the first fluid path and the second fluid path.

* * * * *